US005894970A

United States Patent [19]

Belkin et al.

[11] Patent Number: 5,894,970

[45] Date of Patent: Apr. 20, 1999

[54] SOCK OR STOCKING APPLICATION DEVICE AND METHOD OF USE

[75] Inventors: Julie Belkin, Los Gatos; Mark Jackson, Fresno, both of Calif.

[73] Assignee: North Coast Medical, Inc., San Jose, Calif.

[21] Appl. No.: 08/835,691

[22] Filed: Apr. 10, 1997

[51] Int. Cl.[6] ..... A47G 25/90

[52] U.S. Cl. ..... 223/112; 223/111

[58] Field of Search ..... 223/111, 112, 223/113, 118

[56] References Cited

U.S. PATENT DOCUMENTS

| | | | |
|---|---|---|---|
| 3,310,209 | 3/1967 | Clauss | 223/111 |
| 3,401,856 | 9/1968 | Berlin | 223/111 |
| 3,452,907 | 7/1969 | MacLauchlan | 223/111 |
| 3,853,252 | 12/1974 | Scianimanico | 223/111 |
| 4,066,194 | 1/1978 | Leland . | |
| 4,238,061 | 12/1980 | Marchetti et al. . | |
| 4,284,216 | 8/1981 | Leland . | |
| 4,497,424 | 2/1985 | Smith . | |
| 4,651,909 | 3/1987 | Barting | 223/111 |
| 4,991,757 | 2/1991 | Deakyne | 223/111 |
| 5,031,806 | 7/1991 | Alpert . | |
| 5,050,783 | 9/1991 | Hunter . | |
| 5,322,199 | 6/1994 | White . | |

*Primary Examiner*—Bibhu Mohanty
*Attorney, Agent, or Firm*—Malcolm B. Wittenberg

[57] ABSTRACT

A device to assist in the application of a sock or stocking onto the foot and ankle of the user. The device includes an elongated shell having first and second ends, a base and side walls wherein the shell is U-shaped in cross-section, the base and each of the side walls being substantially planar. Each of the side walls are characterized as having outwardly turned lips and the shell also includes an upwardly turned tongue element and a cord whose ends are affixed to the shell.

4 Claims, 2 Drawing Sheets

SOCK OR STOCKING APPLICATION DEVICE AND METHOD OF USE

TECHNICAL FIELD OF THE INVENTION

The present invention deals with a device to assist in the application of a sock or stocking by those whose physical condition makes bending to apply such articles of clothing difficult. The present invention differs from prior devices used for the same purpose by providing a semi-rigid shell in a unique configuration to greatly facilitate the sock or stocking application.

BACKGROUND OF THE INVENTION

As noted previously, the present invention is intended to be used by those persons who would otherwise experience difficulties when bending down for putting on socks or stockings. In applying such articles of clothing, the user must bend the body until the foot is reached. Although this maneuver presents no real problem for those who are physically fit, for others such as those suffering from, for example, arthritis, sciatica, low back pain, as well as those who are overly obese or who are recovering from surgery to the spine and for normal, healthy women in the later stages of pregnancy, the ability to bend the required extent can prove to be a formidable task.

For those who are incapacitated, it is oftentimes necessary to seek the assistance of another in order to apply socks or stockings. However, a significant segment of the elderly and the infirm live alone and, without some type of assistance, the application of socks or stockings would otherwise prove to be impossible.

Although devices of this nature have been available for over twenty years, all such designs generally fall into two basic categories. The first category involves those devices which are composed of molded or hard plastic produced by an injection molding process. The second variety consists of a more flexible body generally in the form of a sheet of flexible polyethylene plastic.

The molded devices are virtually all of the same shape with only minor variations in accessories. These devices are semi-circular in cross-section with an opening for the foot to slip in. The sock is stretched over the molded device and held in place by a notch in the plastic or by a disk or wedge of foam that adds some resistance to prevent the sock from slipping off of the molded plastic body. A long rope or yarn with handles is attached to allow persons to control the plastic body without having to bend forward to bring their foot up to don the sock.

The flexible plastic sheet material constituting the second category of such devices also commonly uses a disk of foam or, in one case, terry cloth cover, to help hold the sock in place. When the sock is drawn onto the flexible sheet, the sheet bends to conform to the diameter of the sock and thus takes on a semi-circular shape. The flexible product also employs long-handled rope or yarn to facilitate application of the sock to the foot and ankle of the user. As such, once the sock is put onto the device, whether molded or of a flexible style, the foot is then placed into the curved body of the device and it, together with the sock is pulled up the leg. The device is then released by the user once the sock extends over the ankle.

As noted previously, all current designs are semi-circular in cross-section either by being molded as such or by assuming such a cross-section once the device, in the form of flexible sheeting material, is placed within the sock. All such prior art devices exhibit only marginal utility for the human foot, not being circular in shape, does not readily conform to such devices. In addition, existing designs do not accommodate even the average width foot let alone the wider or splayed foot. It has thus been observed that existing devices have always been made to fit a sock, but not the human foot.

In addition to the above, the use of notches or foam pads to help keep the sock in place on the device until it has been pulled into the foot and ankle of the user have proven to be problematic. The notch system serves to help hold the sock in place while it is pulled onto the device but does not serve a functional purpose once the sock is no longer gathered at the top of the device. Foam disks glued onto such devices tend to fall off with repeated use. Foam disks may also catch the sock or stocking and prevent them from being pulled to within reach.

It is thus an object of the present invention to provide a device having a unique configuration resulting in a product which more readily functions to capture a sock or stocking, apply the sock or stocking to the foot and ankle of the user and release from the sock or stocking once the application of the sock or stocking has been completed.

These and further objects of the present invention will be more readily appreciated when considering the following disclosure and appended drawings.

SUMMARY OF THE INVENTION

The present invention involves a device and method for using the device to assist in the application of a sock or stocking onto the foot and ankle of a user. The device comprises an elongated shell having first and second ends, a base and side walls. The shell is substantially U-shaped in cross-section wherein the base and each of the side walls are substantially planar. In addition, each of the side walls are further characterized as having outwardly turned lips proximate the first end of the elongated shell. The device also comprises an upwardly turned tongue element proximate the first end of the shell and a cord whose ends are affixed to the second end of the shell.

DETAILED DESCRIPTION OF THE INVENTION

Figure 1:
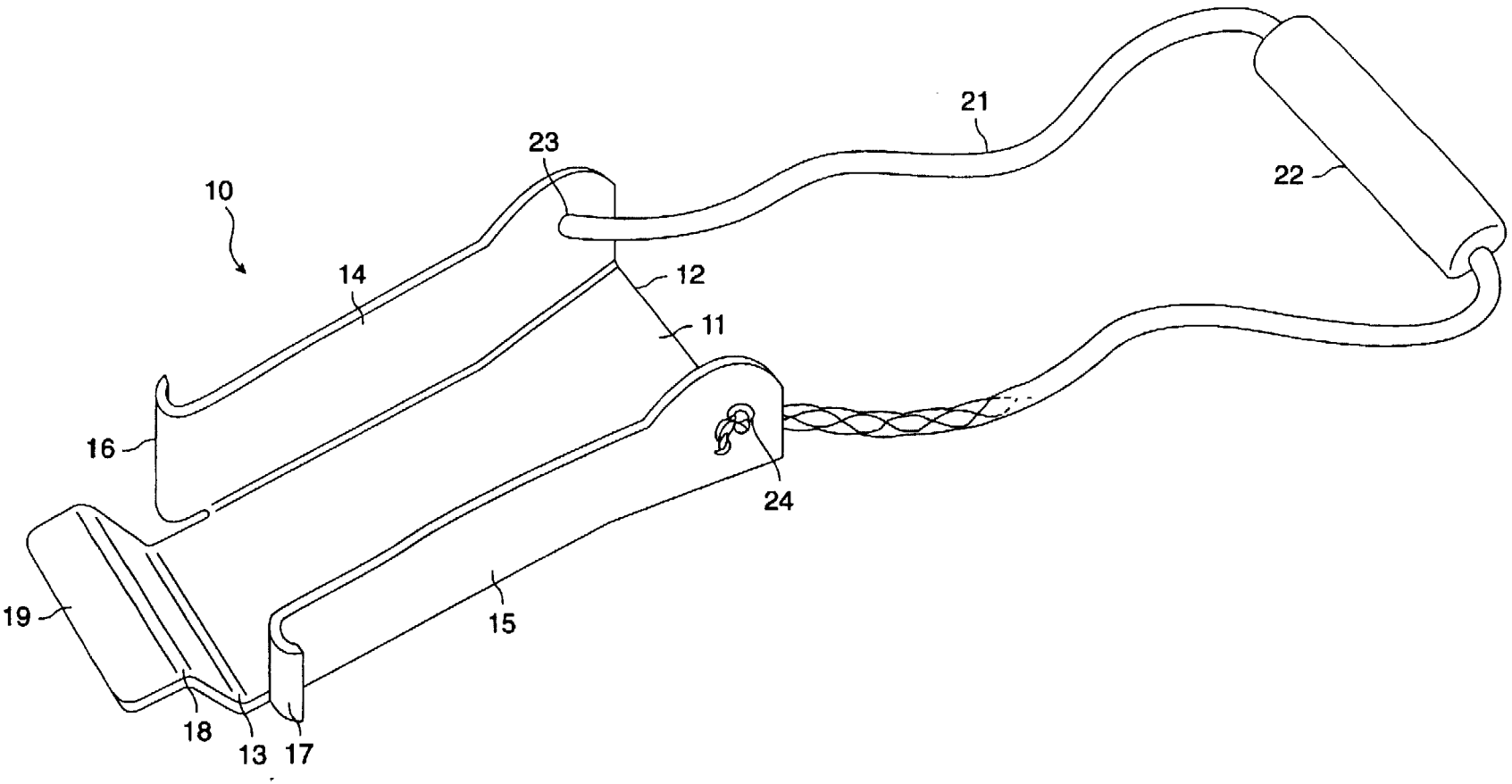
FIG. 1 is a perspective view of the device of the present invention.
Figure 2:
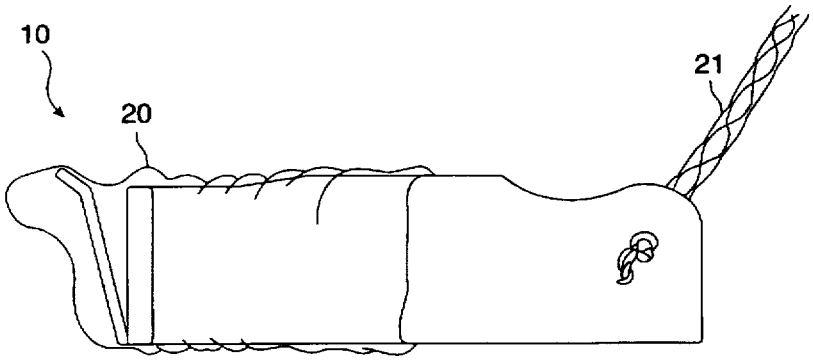
FIG. 2 is a side view of the device of the present invention having a sock installed thereon for application to a user's foot.
Figure 3:
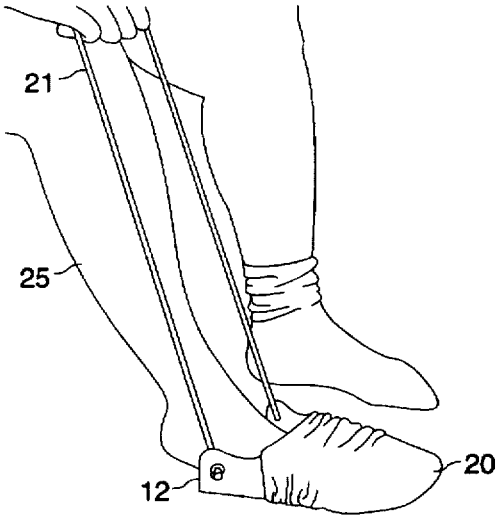
FIGS. 3 and 4 illustrate the use of the device of the present invention whereby the sock of FIG. 2 is shown as being applied to the user's foot and over the user's ankle in practicing the present invention.
Figure 4:
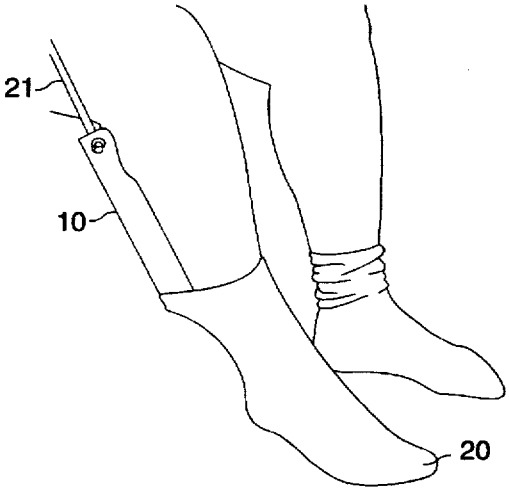

The present invention can perhaps best be visualized by making reference to FIG. 1. In this regard, device 10 is employed to assist in the application of a sock (element 20 of FIG. 2) onto the foot and ankle of the user as shown in FIGS. 3 and 4.

Device 10 comprises an elongated shell having first and second ends 12 and 13. The device also includes base 11 and side walls 14 and 15, each of which are shown as being substantially planar. As such, the cross-section of device 10 cannot be characterized as being curved but, instead, planar sections 11 (base), 14 and 15 (side walls) are each planar and meet in an angular relationship.

Device 10 is both wider and shallower than existing molded devices of this type. The shallowness of shell 10 allows socks and stockings to stretch onto the shell easily while the width of the device accommodates even a man's wide foot. In practice, at the widest point, the existing semi-circular molded device currently being sold is three and five-eighths inches wide while the present shell is five and one-quarter inches wide. In addition, the depth of current molded products known to applicant are two and seven-eighths inches as compared to two and five-sixteenths inches for shell 10. Further, as previously noted, the bottom of shell 10 is flat allowing a wide foot to fit fully into the shell. By contrast, semi-circular designs prevent the foot from resting and conforming to the device as it is actually narrower at its base than at its rim.

Shell 10 of the present invention does not employ notches or foam to hold sock 20 in place as the shell is pulled onto the leg of the user. By contrast, shell 10 employs outwardly turned lips 16 and 17 on side walls 14 and 15, respectively. Lips 16 and 17 are located proximate first end 13 of shell 10 and are used to "catch" a sock or stocking as it is pulled up the leg and is quite effective to release the top of the sock or stocking once it reaches lips 16 and 17 as best seen in FIG. 4.

Yet a further feature which distinguishes shell 10 from prior devices is the use of upwardly turned tongue element 18 which, preferably, is provided with lip 19 which, together, greatly facilitates the use of shell 10 for its intended purpose. Specifically, upwardly turned tongue 18 and lip 19, together, substantially prevent shell 10 from turning on the user's leg 25 and guides shell 10 up the back of leg 25 during use. By contrast, the semi-circular molded devices of the prior art as well as the flexible sheet material of the prior art all exhibit a tendency to turn and twist on the leg as they are drawn upwards. This leaves the sock or stocking twisted on the leg, often resulting in a "heel up" position of the sock.

Further, tongue 18 and lips 16 and 17 allow the sock or stocking to be placed onto shell 10 with the use of only one hand. This is important for products of this nature are frequently prescribed for use by persons who have suffered a cerebral vascular accident (CVA or stroke) and who have use of only one hand making the device of the present invention extremely user friendly.

FIGS. 3 and 4 readily illustrate the use of the present invention. Once sock 20 has been placed partially over shell 10 as shown in FIG. 2, the foot of the user is inserted within end 12 of shell 10 as shown in FIG. 3. At that time, the user grabs handle 22 of cord 21, the latter ideally being affixed to side walls 14 and 15 proximate second end 12 of shell 10 as best shown in FIG. 1. Handle 22 is then pulled upwardly resulting in the application of the sock or stocking over the user's ankle. Once the sock or stocking has been extended, shell 10 conveniently slides over the top of sock 20 whereby lip 16 and 17 slide over the interior of sock 20 15 releasing shell 10 from contact with leg 25 of the user.

It is seen that none of the operations described above requires the wearer to bend down or lean forward so that any difficulties which the wearer might have preventing the user from engaging in a bending or stretching movement are done away with.

I claim:

1. A device to assist in the application of a sock or stocking onto the foot and ankle of user, said device comprising an elongated shell having first and second ends, a base and side walls, said shell being substantially U-shaped in cross-section wherein said base and each of said side walls is substantially planar, each of said side walls being further characterized as having outwardly turned lips proximate said first end of said elongated shell, said device also comprising an upwardly turned tongue element proximate said first end of said shell and a cord whose ends are affixed to said second end of said shell.

2. The device of claim 1 wherein said ends of said cord are affixed to said side walls proximate said second end of said shell.

3. The device of claim 1 wherein said tongue is further provided with a lip extending away from said shell.

4. A method of applying a sock or stocking onto the foot and ankle of a user who would otherwise experience difficulty in applying the sock or stocking without use of said method, said method comprising applying said sock or stocking over at least a portion of a device, said device comprising an elongated shell having first and second ends, a base and side walls, said shell being substantially U-shaped in cross-section, wherein said base and each of said side walls is substantially planar, each of said side walls being further characterized as having outwardly turned lips proximate said first end of said elongated shell, said device also comprising an upwardly turned tongue element proximate said first end of said shell, said method further comprising extending the user's foot into said shell so that said foot rests upon said base between said side walls whereupon said device is pulled across the user's ankle by pulling upon said cord until said device is pulled from said sock or stocking.

* * * * *